United States Patent [19]

Mansell

[11] Patent Number: 4,803,111

[45] Date of Patent: Feb. 7, 1989

[54] MEMBRANE ROOFING SYSTEM

[75] Inventor: William T. Mansell, Forestville, Australia

[73] Assignee: Chadwick Industries Pty. Limited, Lane Cove, Australia

[21] Appl. No.: 163,133

[22] Filed: Feb. 24, 1988

Related U.S. Application Data

[63] Continuation of Ser. No. 769,693, Aug. 27, 1985, abandoned.

[51] Int. Cl.[4] ..... B32B 3/10

[52] U.S. Cl. ..... 428/139; 428/137; 428/138; 428/198

[58] Field of Search ..... 428/137–139, 428/198

[56] References Cited

U.S. PATENT DOCUMENTS

| | | | |
|---|---|---|---|
| 2,240,326 | 4/1941 | Burns | 428/140 |
| 2,745,779 | 5/1956 | Ritter et al. | 428/140 |
| 3,173,991 | 3/1965 | Breakfield, Sr. | 428/140 |
| 3,369,958 | 2/1968 | Fleeman | 428/138 |
| 3,398,041 | 8/1968 | Ferree | 428/138 |
| 3,483,664 | 12/1969 | Funk et al. | 52/309 |
| 4,617,221 | 10/1986 | von der Chys | 428/139 |

*Primary Examiner*—Ellis P. Robinson
*Assistant Examiner*—P. R. Schwartz
*Attorney, Agent, or Firm*—Oblon, Fisher, Spivak, McClelland & Maier

[57] ABSTRACT

An improved membrane roofing arrangement is designed to eliminate the problem of "blistering" in prior art single membrane system.

The membrane roofing arrangement comprises a perforated underlay sheet interposed between a single membrane and the roof, the perforated sheet preventing adhesion of the membrane to the roof at the non-perforated portions of the underlay sheet. In this manner, paths are provided between the membrane and roof for venting vapor to the edges of the membrane and/or suitable vents, thereby eliminating blistering of the membrane.

2 Claims, 2 Drawing Sheets

MEMBRANE ROOFING SYSTEM

This application is a continuation-in-part of application Ser. No. 769,693 filed Aug. 27, 1985 now abandoned.

BACKGROUND OF THE INVENTION

1. Field of the Invention

The present invention relates to waterproofing membrane systems. In particular, the invention is directed to an improved method for applying a membrane layer to surfaces such as walls and flat roofs.

2. Discussion of the Background

There are known membranes consisting of multiple layers of bituminous felt (reinforced either with asbestos, fibreglass or polyester), the layers being sealed together with flood pourings of hot roofing asphalt. Membranes traditionally consisted of three, four or five layers of the above materials and were finished with varying surfacing materials including paint, water worn washed river gravel imbedded in a further flood application of roofing asphalt, lightweight asbestos tiles or granolithic concrete topping.

Very early in the development of multilayer membrane systems it was observed that entrapped moisture in the supporting deck material (which typically consisted of structural concrete, lightweight foam concrete, ash concrete or lightweight aggregate concrete) would result in "blisters", i.e. vapour pockets, occurring in the membrane covering if the membrane was bonded firmly to the substrate material. In practical terms it is very difficult to ensure that the substrate is totally dry. With high summer temperatures, moisture (or moisture vapour) in the substrate is drawn to the underside of the membrane material, expands due to the environmental temperature conditions and lifts the membrane from the substrate (referred to as "blistering").

Approximately 25 years ago certain bituminous ventilating underlays were developed (and sold under the trade mark RUBBERVENT by Rubberoid Roofing Limited, U.K.). These underlays allowed for the lateral dispersion of this vapour pressure. Special constructions were used to allow this pressure to escape at parapets, or specially designed vents were incorporated in the roofing system.

The underlay or base layer commonly used in multilayer membrane systems consisted of a standard bituminous felt with a fine granular gravel undersurface to provide escapement channels, with approximately 10 mm diameter perforations occurring at a 75 mm to 100 mm grid frequency.

Small bituminous "rivets" were formed through the above described perforations when bitumen was applied to the upper surface of the base layer for the bonding of the subsequent layers. These rivets provided a small degree of attachment of the membrane to the substrate, but because of the normal dead load of the membrane construction (generally including the weight of the gravel covering or alternatively granolithic paving) this attachment was regarded as a "bonus" rather than the prime reason for the use of this material.

The above described form of ventilation to bituminous membranes has been in common use in Australia for approximately 25 years.

During the past five years, synthetic single layer membranes have become very popular. (Throughout the specification, the term "single layer membrane" has its trade meaning, i.e. a membrane layer suitable for use on its own, with or without an underlay, although further layers can be added).

Single layer membranes fall into many categories, however the most popular are:

1. Butyl
2. Butyl/E.P.D.M. blend
3. E.P.D.M. sheeting
4. P.V.C. sheeting

The average thickness of a single layer membrane is between 1 mm to 2 mm as comPared to traditional multilayer membranes which range from 10 mm to 15 mm in thickness (excluding the gravel, tile or granolithic paving surfacing).

The single layer systems exhibit desirable characteristics that were unavailable in relation to multilayer traditional bituminous systems, including:

a. flexibility (stretchability)
b. "cold" application (as opposed to the requirement for hot bitumen for traditional bituminous membranes)
c. speed of installation (a single layer is a lot easier to apply than multi layer traditional construction)
d. approved aesthetic appearance (pre-coloured synthetic sheets are available)
e. ease of inspection for mechanical failure
f. excellent joining properties between sheets which incorporated "welding" procedures or the introduction of uncured base materials.
g. economy (Petroleum based bituminous products have rapidly increased in price because of increases in base petroleum prices).

Because of the lightweight nature of the material of single layer membranes, secure adhesion to the substrate material is required to ensure that negative pressures created by wind, etc. do not induce "lift" in the membrane system.

As with problems experienced in the early development of multilayer bituminous roofing, solid complete adhesion of a single layer membrane to substrates previously mentioned re-introduces the problem of "blistering" to this form of roof membrane.

The glue line (normally a form of contact adhesive) prohibits the lateral movement of vapour occurring between the underside of the membrane and the substrate material and blistering inevitably occurs where the materials are applied over a "wet" form of construction.

Several systems have been developed in an endeavour to eliminate blistering occurring in single layer membrane systems, some of these being:

(a) Application of ballast

In this instance the membrane is laid in the form of a pre-formed blanket without any form of adhesion occurring between the membrane material and the substrate, the membrane being held in position by the application of a thickness (normally 75 mm minimum) of washed water worn river gravel.

Lack of adhesion allows for the horizontal dispersement of vapour pressure which can be vented in a traditional manner. However, the membrane is loose and the weight and cost of the river gravel are major disadvantages.

(b) Ventilating Strips

Some manufacturers have developed a system of laying polythene pressure sensitive strips in a grid formation (normally a square pattern of 600 mm to 1000 mm grid dimensions) the intention being that the vapour pressure transmits laterally to these strips and is subsequently ventilated through a parapet or alternate venting system. This system is not regarded as a total answer to the problem as blisters can still occur within the square created by the ventilating strips. Also, considerable costs are involved in the application of these tapes.

(c) Mechanical Anchors

Some manufacturers in the U.S.A. (e.g. Carlisle Rubber) have developed a system of mechanical anchors which incorporate plastic clips on a predetermined grid frequency (dependent on the anticipated uplift) with snap on covers which provide mechanical attachment. The major draw back with this system is the stretching/tensioning of the membrane material which can introduce rapid deterioration from normal environmental conditions.

SUMMARY OF THE INVENTION

It is an object of the present invention to overcome, or substantially ameliorate the abovedescribed disadvantages by providing an improved "single layer membrane" roofing system.

According to one aspect of the present invention, there is provided an improved membrane roofing or cladding arrangement comprising a membrane adapted to be fixed adhesively to a substrate, and an underlay layer intermediate said membrane and said substrate, said underlay layer comprising a thin non-bituminous perforated sheet adapted to prevent adhesion of said membrane to said substrate at its non-perforated portions, whereby vapour trapped between said membrane and substrate can disperse through the areas of non-adhesion.

According to another aspect of the present invention, there is disclosed a method of applying a membrane roofing or cladding arrangement said method comprising the steps of (1) placing a thin non-bituminous perforated sheet of underlay material over a substrate, (2) applying adhesive over the substrate/underlay combination, and (3) placing a membrane layer over said underlay material, whereby vapour trapped between said membrane and substrate can disperse through the areas of non-adhesion between said substrate and said membrane.

Preferably, the adhesive is sprayed over the substrate after the underlay material is laid over it so that the adhesive is applied to the substrate only at the perforated portions of the underlay material.

Throughout the specification, the term "perforated" means that the material has holes therein, whether in a uniform pattern or not. The term includes woven and mesh material for example. It is irrelevant how the holes are formed in the material.

The present invention uses the principle of "spot sticking", i.e. fixing the membrane adhesively to the substrate at selected locations. In manual spot sticking, there is no control in application (apart from the skill of the applicator) in relation to the area of bonded material. The present invention ensures a uniformity of the "spots" without reliance on the skill of on-site labour since the spot sticking is determined by the perforation pattern of the underlay.

The underlay sheet can be manufactured from a variety of materials, including "Kraft" paper, polyester or polythene sheet, aluminium foil sheet, fibreglass sheet or asbestos sheet. Preferably, Kraft (brown) paper is used since it is economical, easily procured and perforated, and will decompose in time to allow the vapour pressure to disperse more easily along the areas of non-adhesion between the membrane and substrate.

A non-bituminous underlay is used since the solvent base of the contact adhesive reacts with bituminous layers and the petroleum oil which may result from this reaction causes rapid deterioration of the membrane, particularly in the cases of butyl and butyl/E.P.D.M. sheeting.

BRIEF DESCRIPTION OF THE DRAWINGS

Notwithstanding other forms of the invention, a preferred embodiment thereof will now be described with reference to the accompanying drawings in which.

DESCRIPTION OF THE PREFERRED EMBODIMENTS

Figure 1:
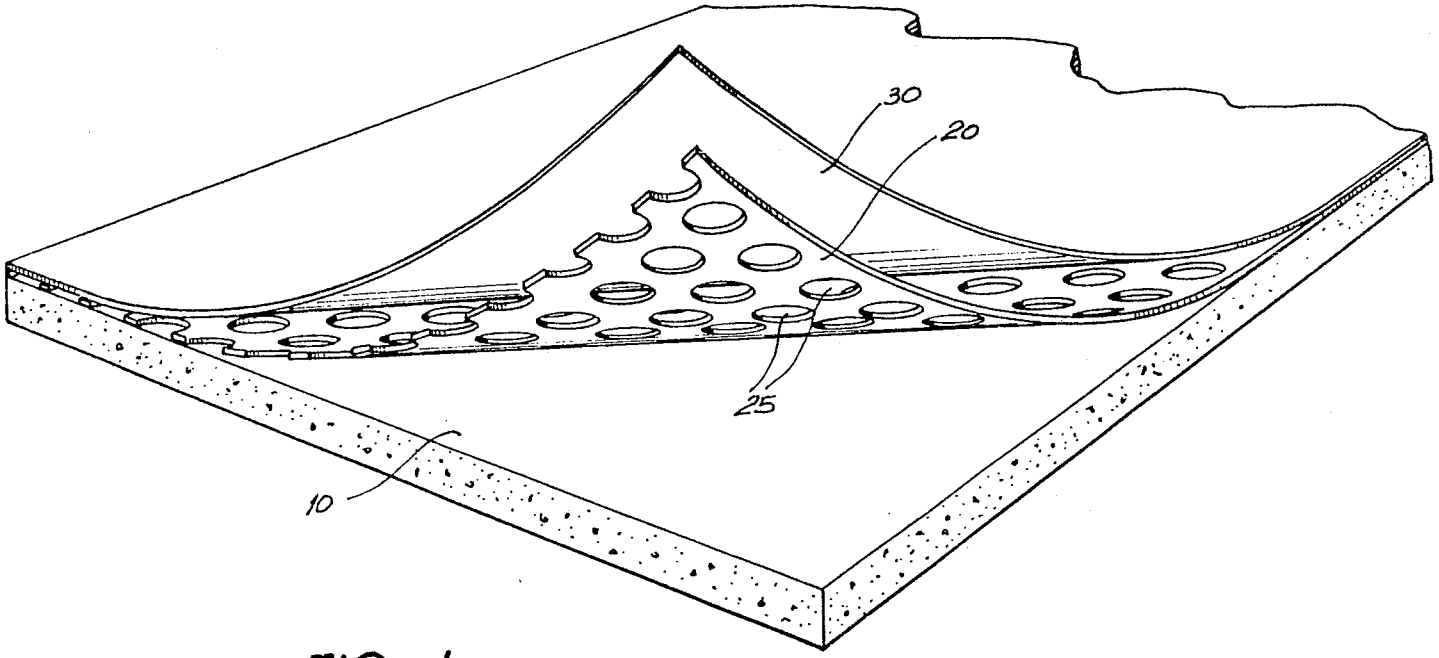
FIG. 1 is a perspective view of an improved membrane roofing arrangement according to the preferred embodiment.
Figure 2:
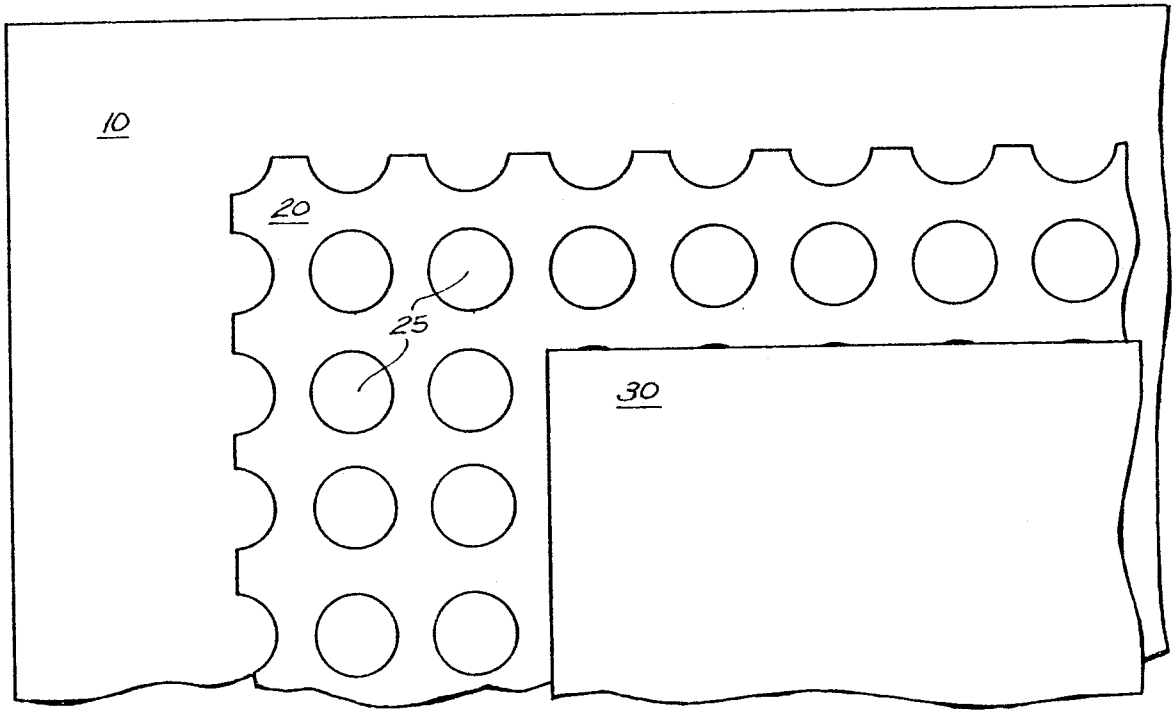
FIG. 2 is a cut-away plan view of the layers of the roofing arrangement of FIG. 1.

As shown in the drawings, the improved membrane roofing arrangement of the preferred embodiment is constructed by rolling out a thin layer of perforated underlay material 20 and allowing it to lay flat on the substrate 10. Perforation dimensions are predetermined to provide an adequate, uniformly distributed adhesion between the substrate 10 and single layer membrane 30.

After the sheet of underlay 20 has been placed in position (without adhesive), contact adhesive is applied over the whole surface, the adhesive only coming in contact with the substrate 10 where the perforations 25 occur in the underlay sheet 20. Preferably, the adhesive is spray applied but other suitable methods will suffice, e.g. roller coating.

Alternatively, the spray application of the contact adhesive to the upper face of the underlay (and exposed area of the substrate) is carried out concurrently with the unrolling of the underlay. It has been found that a certain amount of adhesive provides firm anchorage for the underlay to the perimeter of the perforations.

If required, pressure sensitive adhesive tape can be used to adhere the underlay to the substrate, e.g. in windy conditions. The tape can be placed in short lengths along the edges of the underlay.

The whole of the undersurface of the single layer membrane 30 is similarly covered with contact adhesive and when the membrane 30 is laid over the underlay sheet 20, adhesion between the membrane 30 and the substrate 10 occurs only in those areas corresponding to perforations in the underlay sheet 20. This ensures a ventilation system below the membrane 30 where the underlay sheet 20 is unperforated; the entrapped vapour pressure can uniformly distribute throughout the underside of the membrane and ventilate to a traditional ventilating unit or special perimeter details.

The permanence of durability of the underlay sheet 20 is unimportant. If the perforated underlay sheet 20 deteriorates, bonding between the membrane 30 and the substrate 10 would still not occur as the contact adhesive has been placed on the surface of the substrate 10 only in those areas where perforations occurred.

The foregoing describes only one embodiment of the present invention, and modifications which are obvious to those skilled in the art may be made thereto without departing from the scope of the invention. For example, although the adhesive preferably is sprayed over the perforated underlay layer after it has been placed over the substrate, the adhesive could be sprayed over the substrate before application of the perforated underlay material. The underlay would still prevent adhesion between the membrane and the substrate but, since the vapour would not move between the substrate and the underlay as easily as it would if there was no adhesive between the substrate and the underlay, the performance of this system would not be as good as the preferred embodiment described earlier.

In another embodiment, an adhesive inhibitor is applied in a predetermined pattern (e.g. a mesh pattern) to the underside of the membrane. The underlay is not required and the membrane is glued directly to the substrate but, as the adhesive inhibitor will result in a (mesh) pattern of non-adhesion, vapour will escape along the non-adhesion silicone, or any other known suitable substance, can be used as the adhesive inhibitor.

What I claim is:

1. An improved single layer membrane roofing or cladding arrangement for waterproofing a surface of a substrate, said substrate being a concrete roof, said arrangement comprising:

a synthetic single layer roofing membrane;

an underlay disposed intermediate said membrane and said surface of said concrete roof, said underlay being a thin flat non-bituminous perforated sheet of paper material; and a contact adhesive fixing said membrane to said surface of said roof by adhesive contact, through said perforations, between said membrane and said surface of said roof, non-perforated portions of said underlay presenting a surface of said underlay that is opposed to corresponding portions of said surface of said roof, said opposed surface of said underlay and said corresponding portions of said surface of said roof defining vapor dispersion paths through said arrangement during the effective life of said underlay.

2. A roofing arrangement as claimed in claim 1 wherein said membrane is a single sheet of butyl, butyl-/E.P.D.M. blend, E.P.D.M. or P.V.C. sheeting.

* * * * *